US006837982B2

(12) United States Patent
Barnett et al.

(10) Patent No.: US 6,837,982 B2
(45) Date of Patent: Jan. 4, 2005

(54) MAINTAINING MOLTEN SALT ELECTROLYTE CONCENTRATION IN ALUMINUM-PRODUCING ELECTROLYTIC CELL

(75) Inventors: Robert J. Barnett, Goldendale, WA (US); Michael B. Mezner, Sandy, OR (US); Donald R Bradford, Underwood, WA (US)

(73) Assignee: Northwest Aluminum Technologies, Seattle, WA (US)

( * ) Notice: Subject to any disclaimer, the term of this patent is extended or adjusted under 35 U.S.C. 154(b) by 126 days.

(21) Appl. No.: 10/055,153

(22) Filed: Jan. 25, 2002

(65) Prior Publication Data

US 2003/0141197 A1 Jul. 31, 2003

(51) Int. Cl.[7] ..... C25C 3/22
(52) U.S. Cl. ..... 205/391
(58) Field of Search ..... 422/171; 205/391

(56) References Cited

U.S. PATENT DOCUMENTS

| | | | | | |
|---|---|---|---|---|---|
| 2,713,024 | A | | 7/1955 | Mantovanello | 204/67 |
| 3,951,763 | A | * | 4/1976 | Sleppy et al. | 205/394 |
| 4,101,393 | A | | 7/1978 | Hargis | 204/67 |
| 4,176,019 | A | | 11/1979 | Dethloff | 204/67 |
| 4,333,803 | A | | 6/1982 | Seger et al. | 204/67 |
| 4,397,729 | A | * | 8/1983 | Duruz et al. | 204/243 R |
| 4,431,491 | A | | 2/1984 | Bonny et al. | 204/67 |
| 4,654,129 | A | | 3/1987 | Leroy | 204/67 |
| 4,766,552 | A | | 8/1988 | Aalbu et al. | 364/500 |
| 4,770,752 | A | * | 9/1988 | Gianfranco | 205/391 |
| 4,814,059 | A | | 3/1989 | Nishizawa et al. | 204/406 |
| 5,089,093 | A | | 2/1992 | Blatch et al. | 204/67 |
| 5,279,715 | A | | 1/1994 | LaCamera et al. | 204/64 |
| 5,284,562 | A | * | 2/1994 | Beck et al. | 204/243 R |
| 5,415,742 | A | | 5/1995 | LaCamera et al. | 204/1.11 |
| 5,505,823 | A | | 4/1996 | Rendall | 205/354 |
| 5,718,873 | A | * | 2/1998 | Wellwood et al. | 422/171 |
| 5,779,875 | A | | 7/1998 | Budaev et al. | 205/392 |
| 5,968,334 | A | | 10/1999 | Li | 205/391 |

* cited by examiner

*Primary Examiner*—George Wyszomerski
*Assistant Examiner*—Harry D. Wilkins, III
(74) *Attorney, Agent, or Firm*—Andrew Alexander

(57) ABSTRACT

A method of maintaining molten salt concentration in a low temperature electrolytic cell used for production of aluminum from alumina dissolved in a molten salt electrolyte contained in a cell free of frozen crust wherein volatile material is vented from the cell and contacted and captured on alumina being added to the cell. The captured volatile material is returned with alumina to cell to maintain the concentration of the molten salt.

20 Claims, 3 Drawing Sheets

MAINTAINING MOLTEN SALT ELECTROLYTE CONCENTRATION IN ALUMINUM-PRODUCING ELECTROLYTIC CELL

The government has rights in this invention pursuant to Contract No. DE-FC07-98ID13662 awarded by the Department of Energy.

BACKGROUND OF THE INVENTION

This invention relates to electrolytic production of aluminum and more particularly it relates to a method of maintaining the molten salt electrolyte concentration constant in a low temperature electrolytic cell used for the production of aluminum from alumina dissolved in the molten electrolyte.

The use of low temperature (less than about 900° C.) electrolytic cells for producing aluminum from alumina have great appeal because they are less corrosive to cermet or metal anodes and other materials comprising the cell. The Hall-Heroult process, by comparison, operates at temperatures of about 950° C. This results in higher alumina solubility but also results in greater corrosion problems. Also, in the Hall-Heroult process, carbon anodes are consumed during the process and must be replaced on a regular basis. In the low temperature cells, non-consumable anodes are used and such anodes evolve oxygen instead of carbon dioxide which is produced by the carbon anodes.

The Hall-Heroult process has another disadvantage. That is, in the Hall-Heroult process, the cell operates with a solidified crust or layer that covers the molten electrolyte and thus for the periodic additions of alumina to the cell, the crust must be broken in order to add alumina or make alumina dumps to the molten electrolyte. This has the problem that large quantities of emissions, e.g., fluorides, are lost from the cell and usually are captured along with emissions from other cells. However, this has the problem that each cell operates differently, giving off different amounts of fumes. Thus, addition of make-up electrolyte based on an average is not satisfactory because the average can be too much for one cell and not enough for another, requiring frequent analysis of the electrolyte as well as frequent addition of significant mounts of electrolyte to maintain the desired molten electrolyte concentration.

Different processes have been suggested for operating electrolytic cells for the production of aluminum or feeding alumina to such cells.

For example, U.S. Pat. No. 5,779,875 discloses a method for feeding loose material such as alumina into an electrolytic cell, the method includes the following step of forming at least one material input zone on the surface of an electrolyte, disposing a working tool in the input zone to push the material into the melt of the electrolyte, imparting mechanical oscillations and translatory motions to the working tool in the direction towards the electrolyte and back therefrom with the length of said motions being within the range of values from about 10.0 to about 120.0 sec. The method further includes transporting material into the input zone and forming some layer in the material input zone, and after accumulation of a sufficient amount of the material, the latter enters into contact with the working tool. The aforesaid steps increase the capacity of the material input zone and reduce power expenditures on the input of material into the electrolyte.

Also, U.S. Pat. Nos. 5,415,742 and 5,279,715 disclose a process for electrowinning metal in a low temperature melt.

The process utilizes an inert anode for the production of metal such as aluminum using low surface area anodes at high current densities.

U.S. Pat. No. 5,089,093 discloses a process for controlling an aluminum smelting cell comprising monitoring the cell voltage and current, alumina dumps, additions, operations and anode to cathode distance movements, continuously calculating the cell resistance and the bath resistivity from said monitored cell voltage and current, monitoring the existence of low frequency and high frequency noise in the voltage of the cell, continuously calculating the time rate of change of resistance of the cell, suspending calculation for a predetermined time when an alumina dump is made.

U.S. Pat. No. 4,766,552 discloses a method for controlling alumina feed to reduction cells for the production of aluminum. The method employs an adaptive control with parameter estimation (3) and controller calculation (2) based upon the separation theorem. As a process model there is used a linear model having two inputs and one output. One input ($u_1$) is in the form of alumina feeding minus assumed alumina consumption. Another input ($u_2$) is in the form of movements of the reduction cell anode. The output (y) is in the form of the change in electric resistance across the reduction cell concerned. The model is of the first order in $u_1$ and $u_2$ whereas it is of the order zero in y. An estimated parameter ($b_1$) represents the slope of the curve for resistance as a function of alumina concentration in the electrolytic bath, and the controller (2) controls the addition of alumina to the electrolytic bath in response to the value of $b_1$.

U.S. Pat. No. 4,101,393 discloses a method for the controlled cleaning of aluminum chloride contaminated filtering means used in a system for recovery of gaseous effluents formed in the production of aluminum from aluminum chloride. The method includes transferring filtering units from the system to a cleaning vessel, placing them inside the vessel and sealing the vessel from the environment. Water is flowed into the lower portions of the vessel to immerse the units to cause the aluminum chloride to react with the water, giving off gaseous and liquid products of reaction. Gaseous materials are exhausted from the upper portion of the vessel to a fugitive gas system and the liquid products are discharged from a separate exhaust means. Filtering materials are then stripped from the units to be disposed of without polluting the environment. An apparatus is also provided for carrying out the method of the present invention.

U.S. Pat. No. 4,176,019 discloses that in the scrubbing of gases containing sorbable contaminants, particularly the waste gases from reduction cells for electrolytic production of aluminium the waste gas is injected tangentially into the bottom of a cylindrical chamber, from which it is withdrawn through an axial outlet passage at the top end. A solid sorbent material is introduced into the chamber at one or more positions at the top end of the chamber in such a way that it enters the ascending gas stream in a peripheral zone of the chamber.

U.S. Pat. No. 4,431,491 discloses a process and apparatus for controlling the rate of introduction and the content of alumina to a tank for the production of aluminium by the electrolysis of dissolved alumina in a cryolite-base bath, the upper part of which forms a solidified crust, and wherein the alumina content is maintained within a narrow range, of between 1% and 3.5%, wherein the alumina is introduced directly into the molten cryolite bath by way of at least one opening which is kept open in the solidified crust and the rate at which the alumina is introduced is modulated relative to variations in the internal resistance of the tank during predetermined periods of time, with alternation of the cycles of introducing alumina at a slower rate and at a faster rate than the rate corresponding to normal consumption within the tank.

U.S. Pat. No. 4,814,050 discloses a method of estimating and controlling the concentration of alumina in the bath of a Hall cell. The method includes the use of an estimator that employs two sets of equations, namely, a time update algorithm that contains a dynamic model of the alumina mass balance of the cell and provides estimates of alumina concentration, and a measurement algorithm that uses a process feedback variable from the cell to modify the alumina estimate. In addition, the method includes the use of one or more tuning parameters, such as state noise variance and measurement noise variance. The measurement noise variance is modified by the process noise variance in a manner that increases measurement noise variance for high values of process noise and decreases measurement noise variance for low values of process noise. In addition, one or more of the parameters of the model are modified by the feed history of the cell.

U.S. Pat. No. 5,505,823 discloses a process for smelting aluminum from a mixture of a double salt potassium-aluminum sulfate $2KAl(SO_4)_2$ and aluminum sulfate $Al_2(SO_4)_3$ with potassium sulfate $K_2SO_4$ having a weight ratio of $2KAl(SO_4)_2$ to $K_2SO_4$ in the range of 50/50 to 15/85. The mixture is heated to a eutectic temperature that makes it molten and electrolysis is used to precipitate out aluminum at the negative electrode and gases from SO4 ions at the positive electrode. A critical amount of a feed of $2KAl(SO_4)_2$ is added to replace that which was consumed in the electrolysis and to maintain the weight ratio which provides for the low eutectic melting temperature.

U.S. Pat. No. 5,968,334 discloses a process for recovering at least one of $CF_4$ and $C_2F_6$ from a vent gas from an aluminum electrolysis cell.

U.S. Pat. No. 2,713,024 discloses a process which comprises maintaining the bath at crust-forming temperature conditions, continuously feeding alumina through the crust into the bath, and applying feed pressure through the alumina to the bath surface to thereby penetrate the crust.

U.S. Pat. No. 4,654,129 discloses a process for accurately maintaining a low alumina content of between 1 and 4.5% in a cell for the production of aluminum by electrolysis in the Hall-Heroult process. According to the invention, a control parameter $P=-1/D(dR_1/dt)$, is determined, wherein D is the variation in the alumina content of the electrolytic bath in % weight per hour, $R_1$ is the internal resistance of the cell, and t is the time. A series of operations is then carried out in a repeated cycle, starting with the cell being fed alumina at a nominal rate which is substantially equal to the quantity consumed by electrolysis. At periodic intervals, an over-supply of alumina is added in order to enrich the bath, and the over-supply is continued for a preset time during which $dR_1$ dt is negative. The feed rate is then reduced to less than the nominal feed rate, during which time $dR_1$ dt passes through zero to become positive and the regulation parameter P, the value of which tends to rise, is measured often. The successive values of P are compared with a required preset value Po. As soon as P equals Po, the feed rate is returned to the nominal feed rate and a new cycle is recommenced.

U.S. Pat. No. 4,333,803 discloses a method and apparatus for maintaining a predetermined energy balance in a device, such as an aluminum reduction cell. The apparatus includes a relatively short and thin heat flow sensor having a first and second thermocouple located within opposite closed ends of a hollow thermally conductive body. Each thermocouple is composed of two wires of the same dissimilar metals. The sensor is secured by one closed end of the sensor body to an outside surface of the wall member to extend substantially perpendicular to the location on the wall without significantly affecting the heat flow from the wall surface being measured. A first wire of each thermocouple is of the same metal for electrically connecting the junctions of each thermocouple. The second wire of each thermocouple extends to a location intermediate the closed ends of the sensor body and is electrically connected to an instrument responsive to the electrical potential between the first and second thermocouples. A control means uses the electrical signal to determine the heat flow through the wall member as a function of the temperature difference between the thermocouples and to maintain a predetermined energy balance of the system by adjusting the amount of energy added to the system. The method and apparatus also control the frozen lateral ledge thickness of an aluminum reduction cell.

In spite of these disclosures, there is still a great need for a process that returns electrolytic cell emissions such as fluoride emissions to an electrolytic cell and preferably returns such emissions to the same cell from which they were vented in order to maintain the molten electrolyte at the desired concentration.

SUMMARY OF THE INVENTION

It is an object of the present invention to provide an improved method for producing aluminum from alumina in an electrolytic cell.

It is another object of the invention to provide an improved method for producing aluminum from alumina in an electrolytic cell employing inert or unconsumable anodes.

It is another object of the invention to maintain the composition of the molten salt electrolyte relatively constant.

And, it is another object of the invention to adsorb cell salt emissions on alumina and return the emissions to the cell from which they were vented.

Still, it is another object of the invention to feed alumina continuously to a low temperature, solid crust-free electrolytic cell for making aluminum from alumina.

These and other objects will become apparent from the specification, claims and drawings appended hereto.

In accordance with these objects, there is provided a method for maintaining the salt concentration or composition, e.g., fluoride, during operation of a low temperature electrolytic cell used for the production of aluminum from alumina dissolved in a fluoride-based molten salt electrolyte contained in a cell free of frozen or solid crust. The method comprises providing a fluoride-based molten salt electrolyte at a temperature below 900° C. and providing a plurality of anodes and cathodes, e.g., permanent electrodes, disposed in the electrolyte. Fluorides are vented from the cell along a conduit and alumina is added to the cell through the same conduit. The fluoride fumes or emissions are captured or adsorbed on the alumina as it enters the cell. The captured fluoride is returned to the cell from which it was vented along with other volatiles captured on the alumina. Thus, the composition of molten salt, e.g., fluoride constituent, is more evenly maintained with reduced additions of electrolyte components.

DETAILED DESCRIPTION OF PREFERRED EMBODIMENTS

Figure 1:
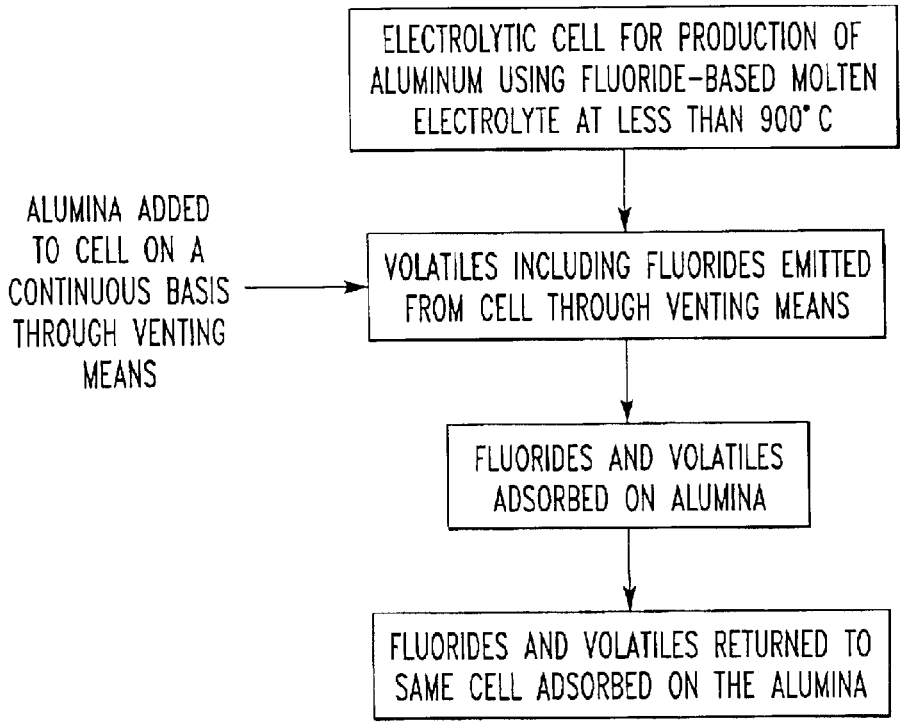
FIG. 1 is a flow chart illustrating steps in the invention.

Referring now to FIG. 1, there is provided a flow chart illustrating steps in the invention. Briefly, from the flow chart, it will be seen that the subject invention includes an electrolytic cell for the production of aluminum from alumina dissolved in a molten salt electrolyte, preferably the molten electrolyte is maintained at less than 900° C. In the method of the subject invention, alumina is added continuously to the cell at a controlled rate in order to ensure a regulated supply of alumina during electrolysis. This may be contrasted to the practice in Hall-Heroult cells where a frozen crust on the cell is broken periodically and a batch of alumina is added or dumped into the molten electrolyte where it is consumed over a period of time.

In the process of the subject invention, electric current is passed through the cell to deposit aluminum at the cathode. Alumina is added to the cell substantially continuously through a conduit. When the cell is operated at 780° C., for example, the molten salt produces volatiles including fluorides which are permitted to escape and thus change the composition of the electrolyte and thus the melting point of the electrolyte. In the Hall-Heroult process, additions of make-up electrolyte must be made every few days to maintain the composition in the cell. In the subject invention, it has been discovered that if the volatiles are withdrawn or are vented through the same conduit through which the alumina is added, the volatiles, including the fluorides, are captured on the alumina. Thus, the molten salt electrolyte volatiles are returned with the alumina feed to the same cell from which they were emitted. Accordingly, the molten salt electrolyte composition of the individual cells is maintained substantially constant, with no need for electrolyte salt additions resulting from a loss of electrolyte volatiles. This process may be contrasted with the Hall-Heroult process where fumes from several cells or potlines are collected together and treated. However, because each cell operates differently, any changes made in the Hall-Heroult cells are based on averages and thus it is difficult to maintain the electrolyte compositions.

Figure 2:
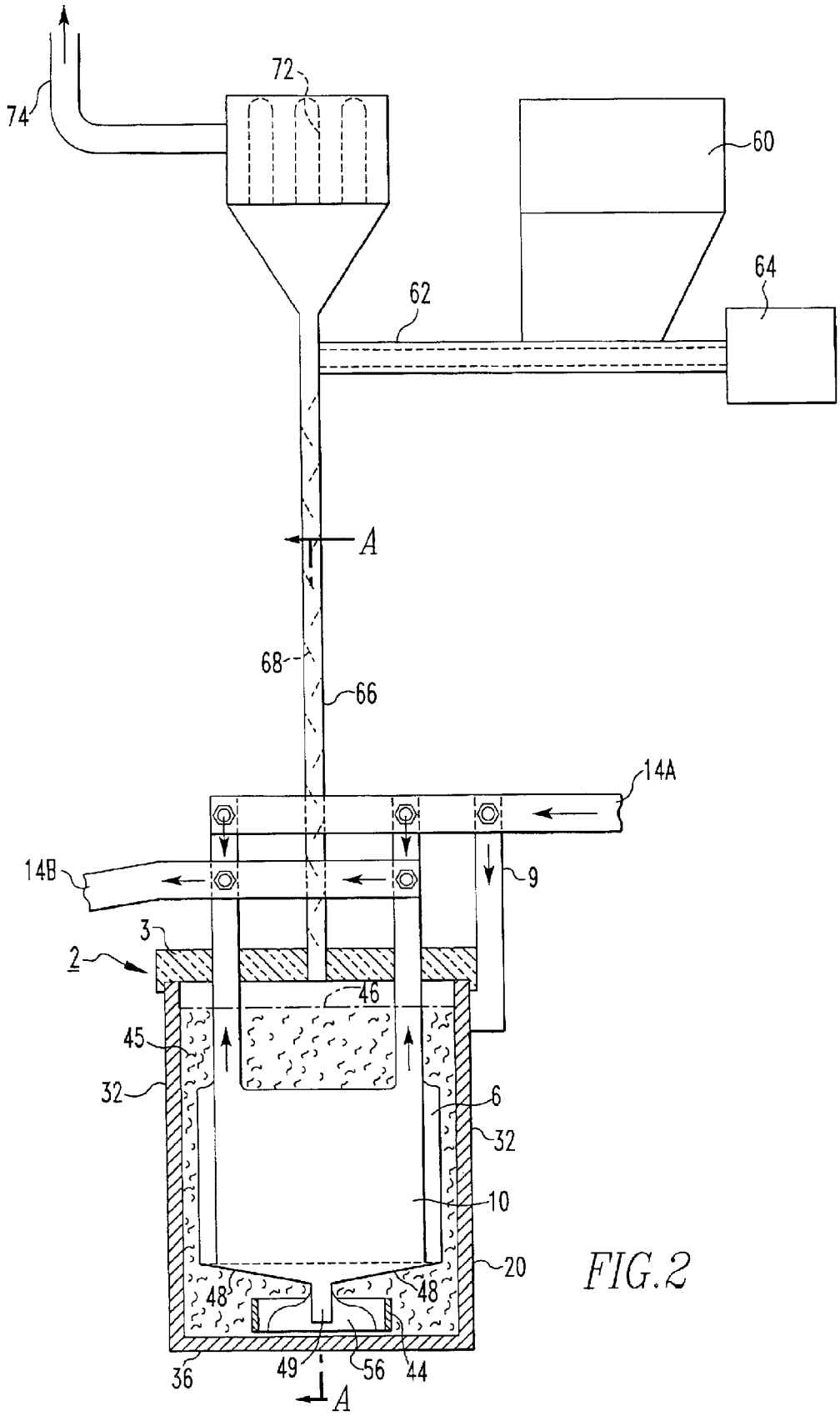
FIG. 2 is a schematic of an electrolytic cell showing continuous alumina feed for capturing molten salt electrolyte volatiles on the alumina fed to the cell.
Figure 3:
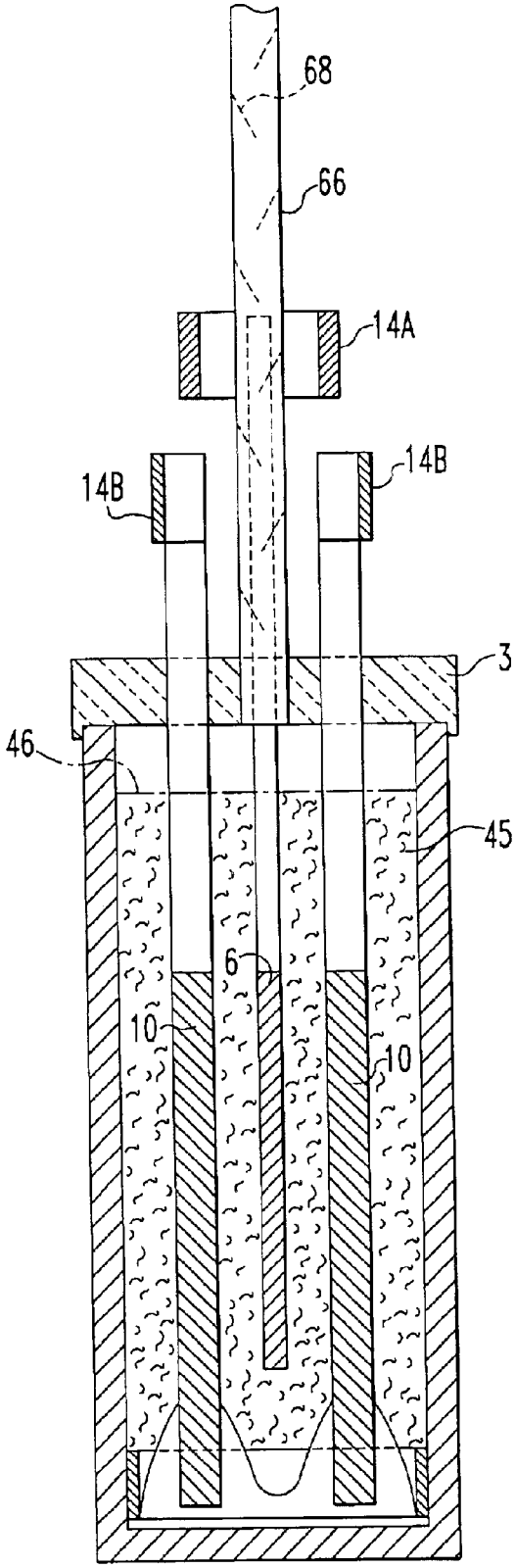
FIG. 3 is a cross-sectional view along the line A—A of FIG. 2.

The present invention was tested in a 300A cell having the configuration shown in FIGS. 2 and 3.

In the cell shown in FIGS. 2 and 3, inert anode cell 2 consists of a metal container 20 that is at anode potential. Within container 20, vertical plate cathodes 10 and vertical plate anode 6 are suspended from bus bars 14B and 14C above the cell. The cell contains a molten salt bath comprised of 38.89 wt. % sodium fluoride and 61.11 wt. % aluminum fluoride. The top of the cell was sealed with an insulating lid 3 and the cell was maintained at an operating temperature of 750° C. which was above the melting point of the salt bath and the aluminum metal. Metal container and anode 6 were comprised of 42 wt. % Cu, 30 wt. % Ni, and 28 wt. % Fe, and the cathode was fabricated $TiB_2$.

Alumina ($Al_2O_3$) was fed continuously into the bath through insulating lid 3. The exhaust gas was extracted through alumina feed tube 66. The feed tube was equipped with baffles 68 to improve contact of alumina particles with the exhaust gas stream. Because of the high adsorption of gaseous fluoride on alumina, a high percentage (99.9+%) of the gaseous fluoride emitted was collected on the incoming alumina feed and returned to the molten salt bath.

Alumina having particle size of about 100 $\mu$m was stored in ore bin 60 and metered into the feed tube 66 by a volumetric metering screw 62. The metering screw was driven by a variable speed motor 64 which could be manually or computer-controlled to increase or decrease alumina feed the anodes and cathodes of the cell. Alumina particulate fines and any escaping fluoride particulates were collected in a bag-type dust collector 72. The volume of exhaust gas and its velocity was very low, allowing the majority of the dust discharged from cleaning dust collector 72 to mix with the fresh alumina feed and fall into the cell.

Cleaned exhaust gas 74 which was mainly oxygen produced at the anode during electrolysis was exhausted to the atmosphere.

In the cell shown in FIGS. 2 and 3, liquid aluminum metal was drained from the cathode plates into an insulated reservoir on the bottom of the cell, where it is periodically removed by siphoning. This cell was operated with precise control of the continuous alumina feed and concentration of alumina in the molten salt bath which was effectively ingested by the natural circulation of the salt bath within the cell.

It can be seen from FIG. 2 that cathodes 10 have lower edges 48 which terminate in protrusion 49. Positioned underneath cathodes 10 and protrusion 49 is channel 44 which is located on bottom 36. When container 32 is metallic and used as an anode, then channel 44 is comprised of an electrical insulating material substantially non-reactive with molten electrolyte or molten aluminum. Electrical insulating material may be boron nitride or other suitable non-reactive material. During operation of the cell, aluminum deposited on the cathode flows or drains towards protrusion 49 and is collected in channel 44 and may be removed by siphoning.

In operation of the cell, as noted earlier, alumina provided in hopper 60 is directed along line or metering screw feeder 62 which is powered by motor 64. Alumina from hopper 60 is directed along feeder screw 62 into pipe or tube 66 and flowed onto surface 46 of electrolyte 45 to provide alumina feed thereto substantially continuously. During electrolysis in cell 2 oxygen produced at the anode provides substantial stirring and vigorous mixing of molten electrolyte 45, thus as alumina is introduced, it is quickly ingested into the electrolyte.

During operation of the cell, exhaust gas such as oxygen produced at the anode and emissions such as fluorides or volatiles from the molten salt electrolyte are generated and vented from the cell along alumina feed tube 66. Baffles 68 are provided in feed tube 66 to improve contact of the emissions with the incoming alumina. In this arrangement, it has been found that a high percentage, e.g., 97 to 99%, of the gaseous fluorides and volatiles of molten salts emitted are collected on the incoming alumina and returned to the bath. Any fines of alumina and escaping fluorides are captured in bag-type dust collector 72 and can be returned to the cell on a scheduled basis. Cleaned exhaust gas which consists primarily of oxygen along with any air leaked into the cell is vented to the atmosphere along pipe 74. It will be appreciated that other configurations or systems can be used to capture emissions and such is contemplated. For example, exhaust gas dust collector discharge could be directed to alumina feed hopper 60 and routed to the cell in this manner.

By operating the cell in accordance with the invention, electrolyte emissions, e.g., fluorides, are returned and the composition of the bath or electrolyte does not change substantially from loss of electrolyte. Thus, precise control of the ratio of sodium, aluminum and fluoride, for example, in the electrolytic bath salts is obtained.

It will be noted that lid 3 is provided and insulated to permit operation of the cell without a solid or frozen crust. Also, thermal insulation may be provided sufficient to permit operation of the cell without a frozen sidewall. That is, the use of an electrolyte having a low melting point, e.g., less than 900° C., permits operation of the cell without a frozen crust and frozen sidewalls necessary for the higher temperature salts.

While any inert anode including cermets or metal alloys may be used in the electrolytic cell of the invention, it is preferred that the anode material including the anodic liner, when used, be comprised of Cu—Ni—Fe compositions that have resistance to corrosion or reaction with the electrolyte. Suitable anode compositions are comprised of 25–70 wt. % Cu, 15–60 wt. % Ni and 1–30 wt. % Fe. Within this composition, a preferred anode composition is comprised of 35–70 wt. % Cu, 25–48 wt. % Ni and 2–17 wt. % Fe with typical compositions comprising 45–70 wt. % Cu, 28–42 wt. % Ni and 13–17 wt. % Fe.

The anode can be any non-consumable anode selected from cermet or metal alloy anodes inert to electrolyte at operating temperatures. By use of the terms "inert" or "non-consumable" is meant that the anodes are resistant to attack by molten electrolyte and do not react or become consumed in the same manner as carbon anodes. The cermet is a mixture of metal such as copper and metal oxides and the metal alloy anode is substantially free of metal oxides. A preferred oxidation-resistant, non-consumable anode for use in the cell is comprised of iron, nickel and copper, and containing about 1 to 50 wt. % Fe, 15 to 50 wt. % Ni, the remainder consisting essentially of copper.

It will be noted that a number of anodes and cathodes can be employed in a commercial cell with the anodes and cathodes used in alternating relationship.

The electrolytic cell can have an operating temperature less than 900° C. and typically in the range of 660° C. (1220° F.) to about 800° C. (1472° F.). Typically, the cell can employ electrolytes comprised of $NaF+AlF_3$ eutectics, $KF+AlF_3$ eutectic, and LiF. The electrolyte can contain 6 to 26 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 62 to 53 mol. % NaF and 38 to 47 mol. % $AlF_3$.

As noted, thermal insulation can be provided around the liner. Also, a lid 3 shown in FIGS. 2 and 3 is provided to seal the cell and provide insulation sufficient to ensure that the cell can be operated without a frozen crust and frozen sidewalls.

The vertical anodes and cathodes in a commercial cell can be spaced to provide an anode-cathode distance in the range of ¼ to 1 inch. Electrical insulative spacers can be used to ensure maintenance of the desired distance between the anode and cathode.

The anodes and cathodes can have a combined active surface ratio in the range of 0.75 to 1.25.

In the low temperature electrolytic cell of the invention, alumina has a lower solubility level than in conventional Hall-type cells operated at a much higher temperature. Thus, in the present invention, solubility of alumina ranges from about 2 wt. % to 5 wt. %, depending to some extent on the electrolyte and temperature used in the cell. Higher temperatures will result in higher solubility levels for alumina. In a temperature range of 715° to 800° C., molten electrolytes useful in the invention have a saturation point for alumina in the range from about 3.2 to 5 wt. % alumina. In the present invention, an excess of alumina over saturation can be maintained in the electrolyte. The ranges provided herein include all the numbers within the range as if specifically set forth.

In the present invention, the alumina is added continuously and thus as alumina is depleted from the electrolyte by electrolysis, feed alumina is supplied at a substantially commensurate rate. By this method of operation, saturation of dissolved alumina is maintained.

Alumina useful in the cell can be any alumina that is comprised of finely divided particles. Usually, the alumina has a particle size in the range of about 1 to 100 $\mu$m.

In the present invention, the cell can be operated at a current density in the range of 0.1 to 1.5 $A/cm^2$ while the electrolyte is maintained at a temperature in the range of 660° to 800° C. A preferred current density is in the range of about 0.4 to 1.0 $A/cm^2$. The lower melting point of the bath (compared to the Hall cell bath which is above 950° C.) permits the use of lower cell temperatures, e.g., 730° to 800° C., and reduces corrosion of the anodes and cathodes.

Having described the presently preferred embodiments, it is to be understood that the invention may be otherwise embodied within the scope of the appended claims.

What is claimed is:

1. A method of maintaining concentration in a low temperature electrolytic cell used for the production of aluminum from alumina dissolved in a molten salt electrolyte contained in a cell free of frozen crust, the method comprising:

(a) providing a molten salt electrolyte at a temperature less than 900° C.;

(b) providing a plurality of anodes and cathodes disposed in said electrolyte;

(c) venting volatile material from said cell through a conduit;

(d) adding alumina on a continuous basis to said cell through said conduit;

(e) capturing said volatile material on said alumina; and (f) returning said captured volatile material to said electrolyte with said alumina thereby maintaining the concentration in said molten salt electrolyte.

2. The method in accordance with claim 1 wherein said electrolyte is comprised of one or more alkali metal fluorides.

3. The method in accordance with claim 1 wherein said electrolyte is comprised of one or more alkali metal fluorides and aluminum fluoride.

4. The method in accordance with claim 1 including maintaining said electrolyte in a temperature range of about 660° to 800° C.

5. The method in accordance with claim 1 including passing an electric current through said cell at a current density in the range of 0.1 to 1.5 $A/cm^2$.

6. The method in accordance with claim 1 wherein said anodes are comprised of a NiCuFe-containing alloy.

7. The method in accordance with claim 1 wherein said cathodes are selected from the group consisting of titanium diboride, zirconium diboride, titanium carbide, zirconium carbide and molybdenum.

8. The method in accordance with claim 1 including providing planer anodes and cathodes in a vertical orientation in said electrolyte and arranging said anodes and cathodes in alternating relationship.

9. The method in accordance with claim 1 including adding said alumina at a rate sufficient to maintain alumina at least at saturation in the molten electrolyte.

10. The method in accordance with claim 1 wherein said anode is a cermet anode.

11. The method in accordance with claim 1 wherein said electrolyte is comprised of sodium fluoride and aluminum fluoride.

12. The method in accordance with claim 1 wherein said electrolyte is comprised of one or more alkali metal fluorides and at least one metal fluoride.

13. The method in accordance with claim 1 wherein said electrolyte is selected from NaF and $AlF_3$ eutectic, and KF and $AlF_3$ eutectic.

14. The method in accordance with claim 1 wherein said electrolyte comprises 60 to 65 wt. % $AlF_3$, the remainder NaF.

15. A method of maintaining fluoride concentration in a low temperature electrolytic cell during electrolytic production of aluminum from alumina dissolved in a fluoride-based molten salt electrolyte contained in a cell substantially free of a frozen crust, the method comprising:

(a) providing a fluoride-based molten salt electrolyte at a temperature less than 900° C., the electrolyte comprised of one or more alkali metal fluorides and at least one metal fluoride;

(b) providing a plurality of anodes and cathodes in said molten electrolyte containing inert dissolved alumina;

(c) passing electrical current from said anodes through said electrolyte to said cathodes and depositing aluminum at said cathode;

(d) venting fluorides containing volatile material from said cell through a conduit;

(e) adding alumina to said cell through said conduit substantially continuously and contacting said fluoride containing volatile material with said alumina;

(f) capturing volatile material on said alumina; and (g) returning said fluorides containing volatile material to said electrolyte with said alumina to maintain the fluoride concentration in said molten salt electrolyte.

16. The method in accordance with claim 15 including maintaining said electrolyte in a temperature range of about 660° to 800° C.

17. The method in accordance with claim 15 including passing an electric current through said cell at a current density in the range of 0.1 to 1.5 $A/cm^2$.

18. The method in accordance with claim 15 wherein said anodes are comprised of a NiCuFe-containing alloy.

19. The method in accordance with claim 15 wherein said cathodes are selected from the group consisting of titanium diboride, zirconium diboride, titanium carbide, zirconium carbide and molybdenum.

20. The method in accordance with claim 15 including providing planer anodes and cathodes in a vertical orientation in said electrolyte and arranging said anodes and cathodes in alternating relationship.

* * * * *